US008823626B2

(12) United States Patent
Minami

(10) Patent No.: US 8,823,626 B2
(45) Date of Patent: Sep. 2, 2014

(54) MATRIX DISPLAY DEVICE WITH CASCADING PULSES AND METHOD OF DRIVING THE SAME

(75) Inventor: Akihiro Minami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 184 days.

(21) Appl. No.: 13/238,031

(22) Filed: Sep. 21, 2011

(65) Prior Publication Data

US 2012/0113090 A1 May 10, 2012

(30) Foreign Application Priority Data

Nov. 4, 2010 (JP) ..... 2010-247541

(51) Int. Cl.
*G09G 3/36* (2006.01)

(52) U.S. Cl.
USPC ..... 345/99; 345/100

(58) Field of Classification Search
CPC .. G09G 3/3688; G09G 3/3677; G09G 3/3648
USPC ..... 345/204, 213, 98–100
See application file for complete search history.

(56) References Cited

U.S. PATENT DOCUMENTS

| | | | | |
|---|---|---|---|---|
| 7,612,789 | B2 | 11/2009 | Minami | |
| 7,773,083 | B2 | 8/2010 | Minami | |
| 2007/0030232 | A1 * | 2/2007 | Minami | 345/98 |
| 2008/0012841 | A1 * | 1/2008 | Morii | 345/204 |
| 2009/0141012 | A1 * | 6/2009 | Tomiyoshi | 345/211 |
| 2010/0079182 | A1 * | 4/2010 | Lien et al. | 327/175 |
| 2011/0169797 | A1 * | 7/2011 | Song et al. | 345/209 |

FOREIGN PATENT DOCUMENTS

| | | |
|---|---|---|
| JP | 2007-41258 | 2/2007 |
| JP | 2009-265132 | 11/2009 |

* cited by examiner

*Primary Examiner* — Chanh Nguyen
*Assistant Examiner* — Jonathan Blancha
(74) *Attorney, Agent, or Firm* — Oblon, Spivak, McClelland, Maier & Neustadt, L.L.P.

(57) ABSTRACT

In a plurality of source drivers, a unit start pulse inputted/outputted to/from the source drivers is cascaded between an ante-stage source driver and a post-stage source driver, a horizontal start pulse outputted from a timing controller is inputted to a first-stage source driver, and the duty ratio of a vertical clock is controlled by one of the plurality of cascaded unit start pulses. In a matrix display device, it is thereby possible to provide a timing controller having a simple circuit configuration which needs no counter circuit for generating a vertical clock to be outputted to a gate driver.

8 Claims, 8 Drawing Sheets

MATRIX DISPLAY DEVICE WITH CASCADING PULSES AND METHOD OF DRIVING THE SAME

BACKGROUND OF THE INVENTION

1. Field of the Invention

The present invention relates to a matrix display device and a method of driving the same, and more particularly, the present invention is preferably applied to a video signal line drive circuit, a scanning line drive circuit, and a timing controller for controlling these circuits, which are incorporated in the matrix display device.

2. Description of the Background Art

Conventionally, there has been a well-known technique relating to timing controllers incorporated in liquid crystal displays, which could be used for liquid crystal panels of various resolutions (Japanese Patent Application Laid Open Gazette No. 2009-265132: Patent Document 1). When such a timing controller generates control signals thereinside in order to control video signal line drive circuits and scanning line drive circuits, the timing controller needs to hold the respective resolutions in vertical and horizontal directions of the liquid crystal panel as parameters. Further, by using the parameters, the timing controller needs to have a counter circuit which is provided thereinside count up to near at least the resolutions.

By using the count value of the counter, it is possible to measure the timing of generating the control signals for controlling the video signal line drive circuits and the scanning line drive circuits and generate various control signals as appropriate.

The signals needed to control the horizontal direction (the video signal line drive circuits) mainly include an image display data signal (representing digital image signals for red, green, and blue, each of which is a bus with several bit width), a horizontal start pulse used by the video signal line drive circuits to determine the start of capture of a valid image display data signal together with a horizontal clock serving as a reference for these operations, a polarity switching signal indicating a polarity in driving the liquid crystal, a latch pulse for transmitting the image display data signal to an output side of the video signal line drive circuit, and the like. Hereinafter, a region in which one red pixel image, one green pixel image, or one blue pixel image is displayed is referred to as one pixel.

In the technique disclosed in Japanese Patent Application Laid Open Gazette No. 2009-265132 (Patent Document 1), a pulse outputted from the output side of a video signal line drive circuit in the last stage of scanning in the horizontal direction is reused in the video signal line drive circuit or the timing controller, to thereby generate a latch pulse. Because of this characteristic feature, it is not necessary to hold the resolution in the horizontal direction as a parameter in the timing controller and therefore, no register or memory for holding the resolution in the timing controller needs to be provided. Further, no external memory of the timing controller for holding the resolution needs to be provided.

Only by the above technique, however, the vertical scan cannot be handled. In the vertical scan, especially, the respective writing times for all the scanning lines basically need to be the same, conventionally, and for this reason, a vertical clock used for the vertical scan needs to be repeated in the same cycle at the same duty ratio, (the number of scanning lines+1) times or more. Therefore, a register or a memory for holding a parameter by which the timing controller knows the number of scanning lines, and a counter circuit are needed.

SUMMARY OF THE INVENTION

It is an object of the present invention to provide a matrix display device having a simple circuit configuration and a method of driving the same, and more specifically, to provide a timing controller having a simple circuit configuration, which needs no counter circuit for generating a vertical clock to be outputted to a scanning line drive circuit.

It is another object of the present invention to provide a matrix display device having a simple circuit configuration, which holds the resolution (the number of lines) in the vertical direction as a parameter to thereby eliminate the necessity of providing any counter for counting the number of driving lines therein so that it can be used for matrix display panels of various resolutions with higher flexibility, and a method of driving the same.

The present invention is intended for a matrix display device. According to an aspect of the present invention, the matrix display device includes a matrix board, a scanning line drive circuit, a plurality of video signal line drive circuits, and a timing controller. The matrix board in which a plurality of pixels surrounded by m scanning lines and n video signal lines are arranged in matrix controls a plurality of pixel transistors connected to the pixels on conduction by a gate signal supplied through the scanning lines and supplies a pixel writing voltage supplied through the video signal lines to the pixels through the pixel transistors. The scanning line drive circuit supplies the gate signal to the scanning lines. The plurality of video signal line drive circuits supply the pixel writing voltage to the video signal lines. The timing controller outputs a display control data signal including a shift start pulse to the video signal line drive circuits and outputs a horizontal scan control signal including a vertical clock to the scanning line drive circuit. In the matrix display device of the present invention, a unit start pulse inputted/outputted to/from the plurality of video signal line drive circuits is cascaded between an ante-stage video signal line drive circuit and a post-stage video signal line drive circuit in the plurality of video signal line drive circuits, the shift start pulse outputted from the timing controller is inputted to a first-stage video signal line drive circuit, and the duty ratio of the vertical clock is controlled by one of the plurality of cascaded unit start pulses.

The present invention is also intended for a method of driving a matrix display device. According to another aspect of the present invention, a unit start pulse is cascaded among a plurality of video signal line drive circuits in a matrix display device and the duty ratio of a vertical clock to be inputted to a scanning line drive circuit is controlled by using a unit start pulse to be outputted from one of the plurality of video signal line drive circuits to the post-stage video signal line drive circuit.

By the present invention, it is not necessary to hold the resolution as a parameter in the timing controller, and this eliminates the necessity of providing any register or memory for holding the display resolution in the timing controller. Further, no external memory of the timing controller is needed in order to hold the resolution.

Since the number of counters decreases as compared with the conventional case, it is possible to reduce a circuit scale of the timing controller.

Further, since the circuit scale of the timing controller decreases, it becomes easier to incorporate the timing controller in the video signal line drive circuit or the scanning line drive circuit.

These and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, discussion will be made on the preferred embodiments of the present invention, with reference to figures. For avoiding redundant description, constituent elements having identical or corresponding functions are represented by the same reference signs in the figures.

The First Preferred Embodiment

Figure 1:
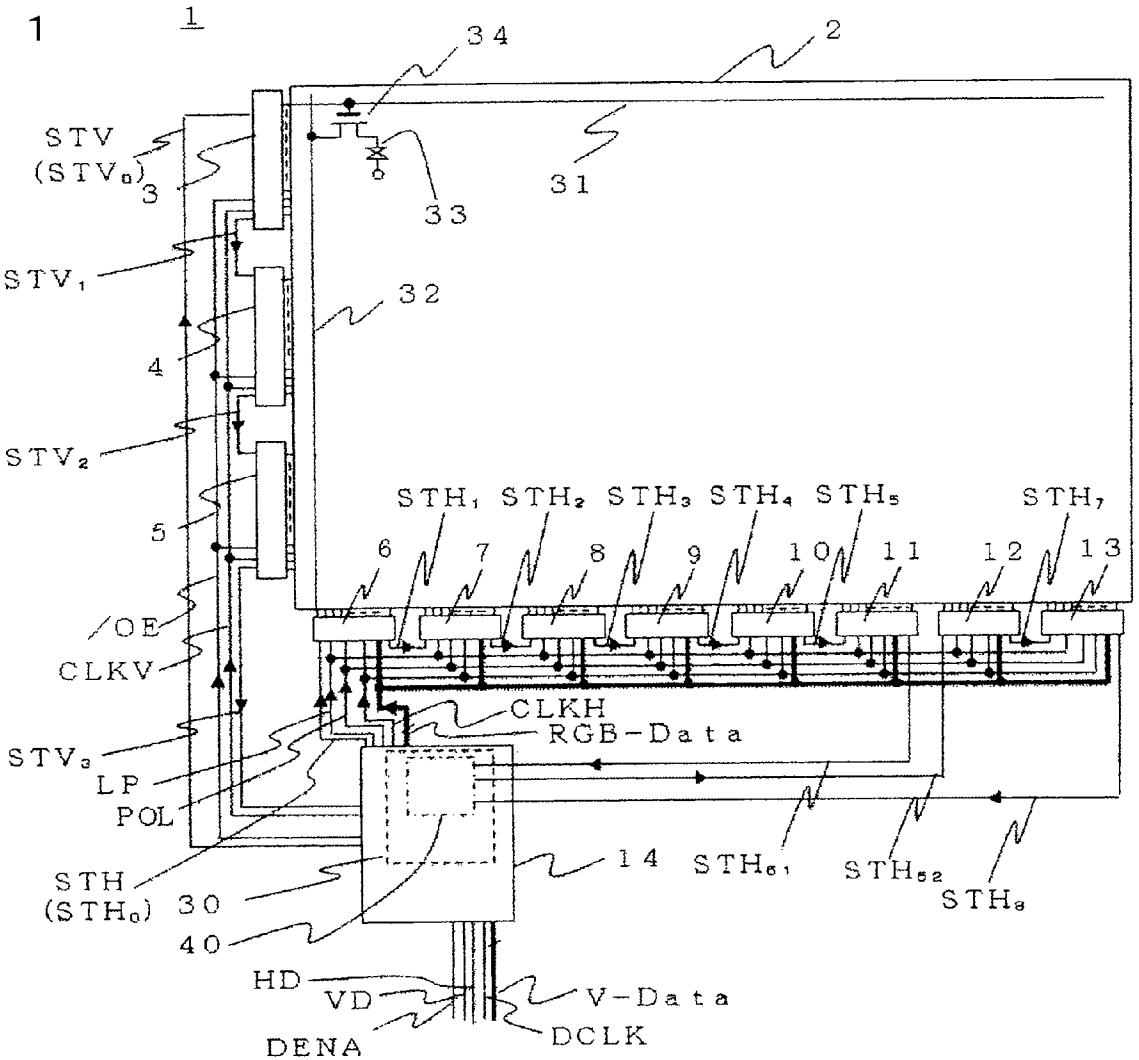
FIG. 1 is a configuration diagram showing a liquid crystal display in accordance with a first preferred embodiment of the present invention.

FIG. 1 shows a circuit configuration of a liquid crystal display 1 in accordance with the first preferred embodiment. More specifically, FIG. 1 shows a configuration including a matrix board in which m scanning lines 31 (m is a natural number not smaller than 2), n video signal lines 32 (n is a natural number not smaller than 2), and pixels 33 located at the intersections of these lines are arranged in matrix, and peripheral circuits for driving a liquid crystal panel 2 having a structure in which a liquid crystal layer is held between not-shown counter substrates.

An image display data input V-Data given from the outside, a plurality of control signals each serving as a control standard, and a dot clock (hereinafter, referred to as "DCLK") serving as a reference for these operations are inputted together to video signal line drive circuits (hereinafter, referred to as "source drivers") 6 to 13 each having x outputs which are arranged to drive the video signal lines 32 of the liquid crystal panel 2 in the liquid crystal display 1, scanning line drive circuits (hereinafter, referred to as "gate drivers") 3 to 5 each having y outputs for driving the scanning lines 31, and a timing controller (hereinafter, referred to as "T-CON") 14 for controlling these drivers.

The above-discussed plurality of signals each serving as a control standard include a horizontal synchronizing signal (hereinafter, referred to as "HD") used as a reference signal for synchronization in the horizontal direction of the liquid crystal panel 2, a vertical synchronizing signal (hereinafter, referred to as "VD") used as a reference signal for synchronization in the vertical direction of the liquid crystal panel 2, a data enable signal (hereinafter, referred to as "DENA") indicating a period while the image display data input V-Data is valid, and the like.

The T-CON 14 uses a timing control unit 30 incorporated therein to generate a driver control signal for driving the source drivers 6 to 13 and the gate drivers 3 to 5. The source drivers 6 to 13 apply a pixel writing voltage to the plurality of video signal lines 32 for displaying a video image in the corresponding pixels 33. Therefore, in the source drivers 6 to 13, a plurality of drive circuits (not shown) connected to the video signal lines 32 are integrated.

Similarly, in order to drive the scanning lines 31, in the gate drivers 3 to 5, a plurality of circuits (not shown) for driving the scanning lines 31 are integrated. Further, the plurality of integrated circuits are used to handle the n video signal lines 32 and the m scanning lines 31 in the liquid crystal panel 2 (FIG. 1 representatively shows a first line as the scanning line 31 and a leftmost line as the video signal line 32 and does not show other lines).

In more detail, the display control data signals for controlling the source drivers 6 to 13, among the driver control signals outputted from the timing control unit 30, mainly includes control signals such as an image display data signal (hereinafter, referred to as "RGB-data": "R", "G", and "B" represents digital image signals for red, green, and blue, respectively, each of which is a bus with several bit width), a reference horizontal clock (hereinafter, the horizontal clock is referred to as "CLKH") used for performing signal processing, a horizontal start pulse STH (hereinafter, referred to simply as "STH") indicating the start of the RGB-data in the horizontal direction, a latch pulse LP for transmitting the RGB-data to the output sides of the source drivers 6 to 13, a polarity switching signal (hereinafter, referred to as "POL") indicating a polarity in driving the liquid crystal, and the like. Hereinafter, a region in which one red pixel image, one green pixel image, or one blue pixel image is displayed is referred to as one pixel.

Hereinafter, for convenience of discussion, the STH outputted from the T-CON 14 is represented as a shift start pulse $STH_0$ and the start pulses (shift complete pulses) outputted from the source drivers 6, 7, 8, 9, 10, 11, 12, and 13 to the next-stage (post-stage) source drivers, respectively, are represented as unit start pulses $STH_1$, $STH_2$, $STH_3$, $STH_4$, $STH_5$, $STH_6$, and $STH_7$ (see FIG. 1).

A horizontal scan control signal for controlling the gate drivers 3 to 5, among the driver control signals outputted from the timing control unit 30, mainly includes a vertical clock (hereinafter, referred to as "CLKV") used for performing signal processing in the gate drivers 3 to 5, a vertical start pulse STV (hereinafter, referred to simply as "STV") indicating the start of the vertical scan, and the like.

Further, a /gate driver output enable signal (hereinafter, a gate driver output enable signal is referred to as an "OE", and the sign "/" indicates that the following signal is negative logic) for controlling the timing and the period of writing to the pixels 33 is outputted from the timing control unit 30 to the gate drivers 3 to 5 and by this signal, the High level/Low level (i.e., activated/inactivated) of the outputs from the gate drivers 3 to 5 is controlled (hereinafter, the "High level" is referred to simply as "High" and "Low level" is referred to simply as "Low"). While the /OE indicating High is inputted to the gate driver, the gate driver causes all the output terminals to apply Low to the scanning lines 31. On the other hand, while the /OE indicates Low, the gate driver performs a normal output operation.

Further, in an ordinary case, the source drivers 6 to 13 write desired image display voltages to the respective pixels corresponding to the scanning lines 31 which are brought into High by the gate drivers 3 to 5, through pixel transistors (hereinafter, referred to as "TFTs") 34 connected to these pixels. This control is sequentially performed for each scanning line 31 and whole image display is thereby performed. In FIG. 1, only the pixel 33 and the TFT 34 on the first column and the first row of the liquid crystal panel 2 are shown and the others are omitted.

Herein, the timing control unit 30 generates the control signals for the source drivers and the gate drivers with a plurality of signals (the HD, the VD, and the DENA) serving as the control standard, to be used as references, and by using the DCLK, among the image signals inputted to display an image.

Figure 2:
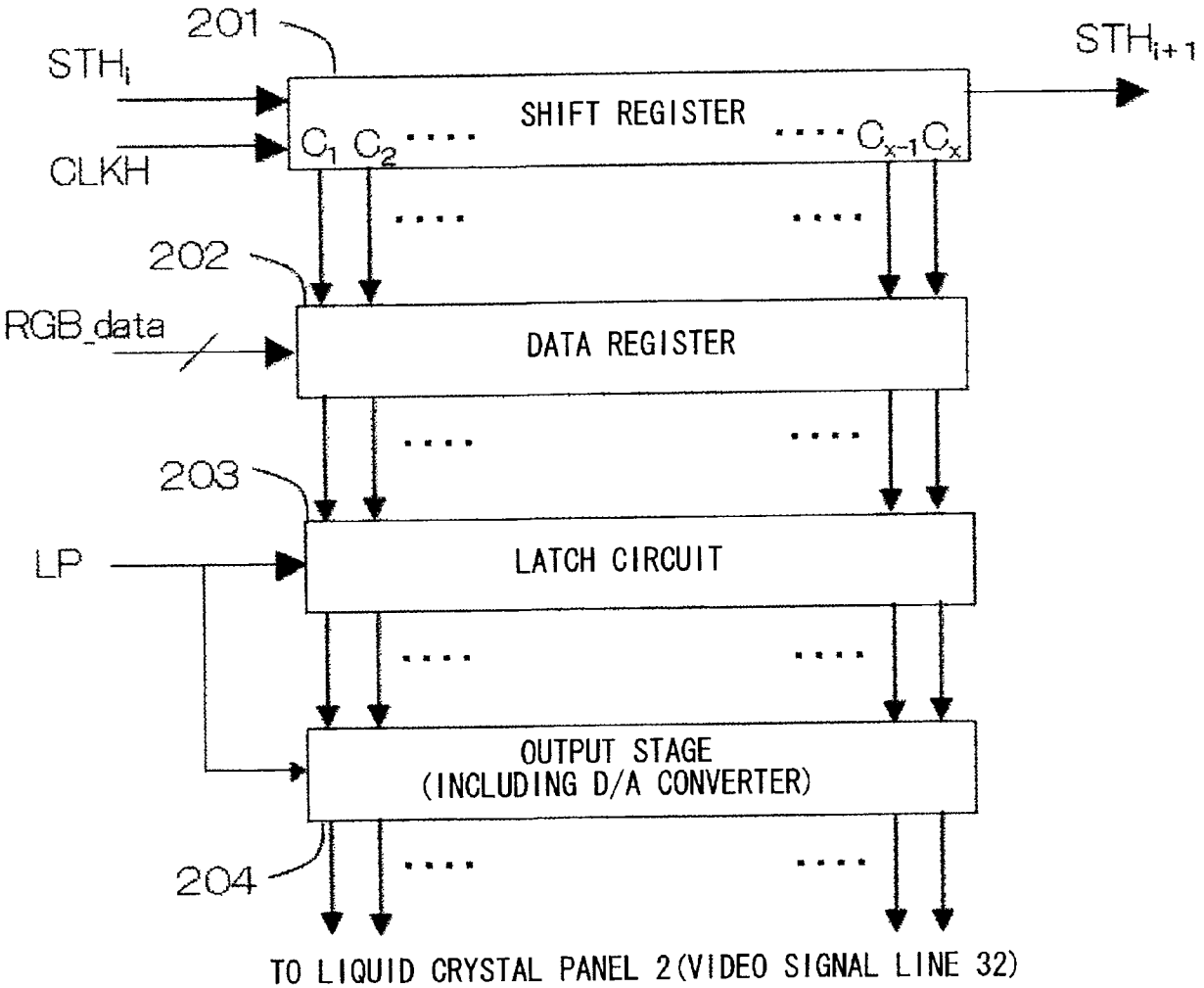
FIG. 2 is a block diagram showing a constitution of a video signal line drive circuit in accordance with the first preferred embodiment of the present invention.
Figure 3:
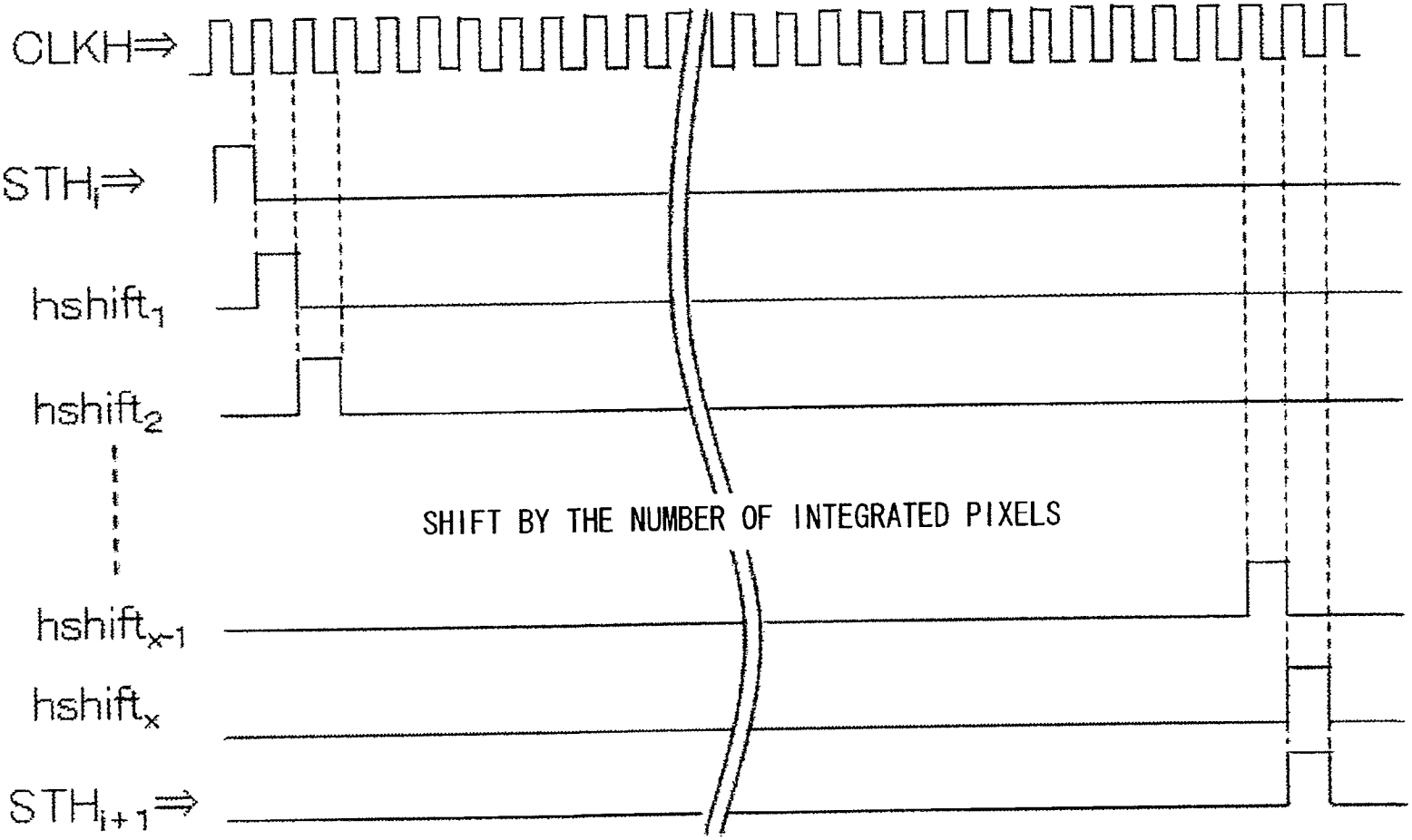
FIG. 3 is a waveform chart showing a state in which a shift operation of internal shift registers is performed in the video signal line drive circuit of FIG. 2.

Since the source drivers 6 to 13 each drives, for example, x video signal lines 32, x drive circuits connected to the video signal lines 32 are integrated inside each thereof. Each of the source drivers 6 to 13 has such an internal structure as shown in FIG. 2, consisting of a shift register unit 201, a data register unit 202, a latch circuit unit 203, and an output stage unit 204. The shift register unit 201, the data register unit 202, the latch circuit unit 203, and the output stage unit 204 each consist of x unit circuits corresponding to the video signal lines 32, respectively. Specifically, the shift register unit 201 consists of x unit shift registers $C_1$, $C_2$, . . . , $C_{x-1}$, and $C_x$, the data register unit 202 consists of x unit data registers (not shown), the latch circuit unit 203 consists of x unit latch circuits (not shown), and the output stage unit 204 consists of x output stages (not shown). Respective functions of the shift register unit 201, the data register unit 202, the latch circuit unit 203, and the output stage unit 204 are the same as those in the conventional art and therefore detailed discussion thereof will be omitted. FIG. 3 shows a general timing chart of this flow. A set of the unit shift register, the unit data register, the unit latch circuit, and the output stage, corresponding to one video signal line 32, is referred to as a unit source driver and one source driver consists of x unit source drivers which are cascaded.

Herein, the unit start pulse $STH_i$ (hereinafter, referred to simply as "$STH_i$", i: 0 to 7) inputted to each of the source drivers 6 to 13 controls the start timing of capturing one set of RGB-data to the source driver for one CLKH. Further, at the same time when a shift operation of the unit shift registers ($C_1$, $C_2$, . . . , $C_{x-1}$, and $C_x$) constituting the shift register unit 201 is completed and the capture of the data is completed in the whole source driver, the unit start pulse $STH_{i+1}$ (hereinafter, referred to simply as "$STH_{i+1}$, i:0 to 7) for the post-stage source driver is outputted (=shift complete pulse), and the pulse becomes the unit start pulse $STH_i$ for the cascaded post-stage source driver. In the source driver 10 of FIG. 1, for example, the unit start pulse $STH_4$ is inputted from the source driver 9 and the unit start pulse $STH_5$ is outputted as a start pulse for the next-stage (post-stage) source driver 11.

Thus, the unit start pulses $STH_i$ of the source drivers 6 to 13 are cascaded as the unit start pulses $STH_1$ to $STH_7$ among the source drivers 6 to 13, and on the other hand, the RGB-data, the CLKH, and the latch pulse LP are connected in parallel commonly for the source drivers 6 to 13.

By the interconnection of the above-discussed unit start pulses $STH_1$ to $STH_7$, the RGB-data, the CLKH, and the latch pulse LP among the source drivers 6 to 13, 8 source drivers 6 to 13 sequentially captures the RGB-data therein.

Especially, though the unit start pulse $STH_6$ (not shown) is once given back to the T-CON 14 as $STH_{61}$ and then given back to the cascaded next-stage (post-stage) source driver 12 as the unit start pulse $STH_{62}$ in FIG. 1, in a normal display period, the unit start pulse $STH_{61}$ is directly given back to the source driver 12 as the unit start pulse $STH_{62}$. In the first preferred embodiment, an interrupt (exceptional operation) is performed in the last period of the vertical scan, and detailed discussion thereof will be made later.

Herein, the control signals of the source drivers 6 to 13, which are generated by the timing control unit 30, include the CLKH, the STH, the latch pulse LP, and the like. The CLKH determines an operation timing of the source drivers 6 to 13.

The STH is a pulse signal which is activated correspondingly to the beginning of each horizontal period of the RGB-data outputted by the timing control unit 30, and this signal determines a capture start timing of the RGB-data in each of the unit source drivers integrated in the source drivers 6 to 13.

The STH outputted from the T-CON 14 is inputted to the first-stage, i.e., the forefront-stage source driver 6 in the cascade connection as the shift start pulse $STH_0$. When a predetermined number of shift operations (read operations of the RGB-data) are completed in the source driver 6, the shift start pulse $STH_0$ is outputted from the source driver 6 as the unit start pulse $STH_1$, then sequentially transmitted to the source drivers 7, 8, . . . , and 13 in a round in the same manner, and finally outputted from the last-stage source driver 13 as a shift complete pulse $STH_8$.

Thus, inside each of the source drivers 6 to 13, each of the cascaded unit source drivers, in synchronization with the $STH_i$ transmitted from the ante-stage source driver, captures the RGB-data from the T-CON 14 while sending the $STH_{i+1}$ to the post-stage one.

As shown in FIG. 3, the operation of the unit source drivers is performed in synchronization with the CLKH. Each of the unit source drivers in the source drivers 6 to 13 sequentially captures the RGB-data transmitted in serial in synchronization with the CLKH at a predetermined capture timing ($hshift_1$, $hshift_2$, . . . , $hshift_{x-1}$, $hshift_x$).

The latch pulse LP is a pulse signal corresponding to the last of one horizontal period of the RGB-data, determining an output start timing at which the RGB-data of one horizontal line which is captured by and held in the source drivers 6 to 13 is outputted from the output stage unit 204 to the video signal line 32 of the liquid crystal panel 2 as the pixel writing voltage. The latch pulse LP is inputted to the source drivers 6 to 13 in parallel. The control signals outputted from the T-CON 14 further include the POL indicating a polarity in driving the liquid crystal, and the like. The T-CON 14 transmits these control signals together with the RGB-data to the source drivers 6 to 13.

Figure 4:
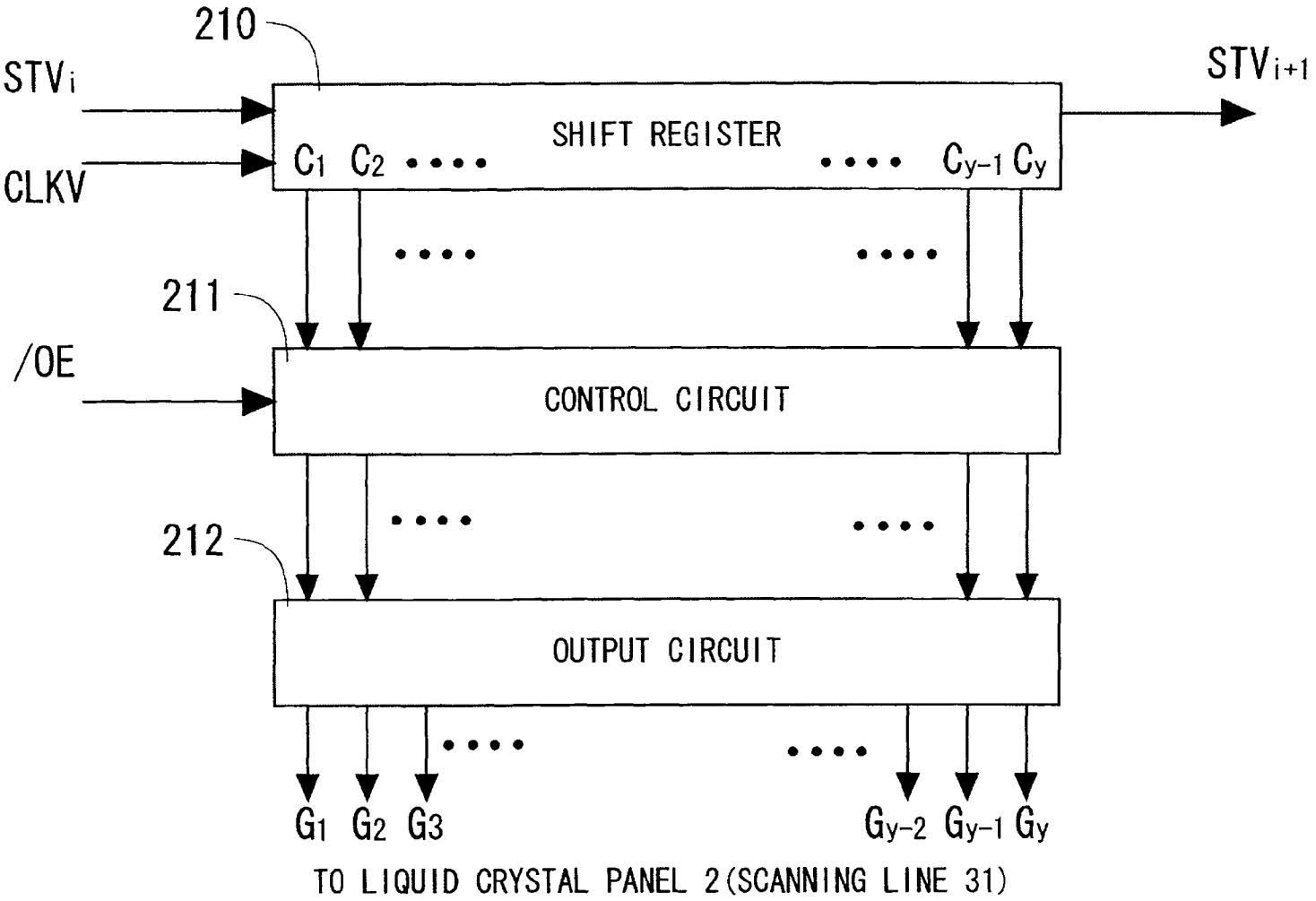
FIG. 4 is a block diagram showing a constitution of a scanning line drive circuit in accordance with the first preferred embodiment of the present invention.

On the other hand, each of the gate drivers 3 to 5 shown in FIG. 1 has such an internal structure as shown in FIG. 4, consisting of a shift register unit 210, a control circuit unit 211, and an output circuit unit 212. The shift register unit 210, the control circuit unit 211, and the output circuit unit 212 each consist of y unit gate drivers corresponding to the scanning lines 31, respectively. Specifically, each of the unit gate drivers consists of unit circuits including a unit shift register ($C_1$, $C_2$, . . . , $C_{y-1}$, or $C_y$), a unit control circuit (not shown), and a unit output circuit (not shown). Respective functions of the shift register unit 210, the control circuit unit 211, and the output circuit unit 212 are the same as those in the conventional art and therefore detailed discussion thereof will be omitted. A set of the unit shift register, the unit control circuit, and the unit output circuit, corresponding to one scanning line 31, is referred to as the unit gate driver and one gate driver consists of y unit gate drivers which are cascaded.

Herein, the unit start pulse $STV_i$ (hereinafter, referred to simply as "$STV_i$", i: 0 to 2) inputted to each of the gate drivers determines an output line $G_1$, $G_2$, . . . , $G_{y-1}$, or $G_y$ to which writing is to be made every time when one CLKV is inputted, and then sequentially determines the next output line. Further, at almost the same time when the shift operation in entire one gate driver is completed, the pulse is outputted as the unit start pulse $STV_{i+1}$ (hereinafter, referred to simply as "$STV_{i+1}$") and connected in cascade to the $STV_i$ of the post-stage gate driver.

Figure 5:
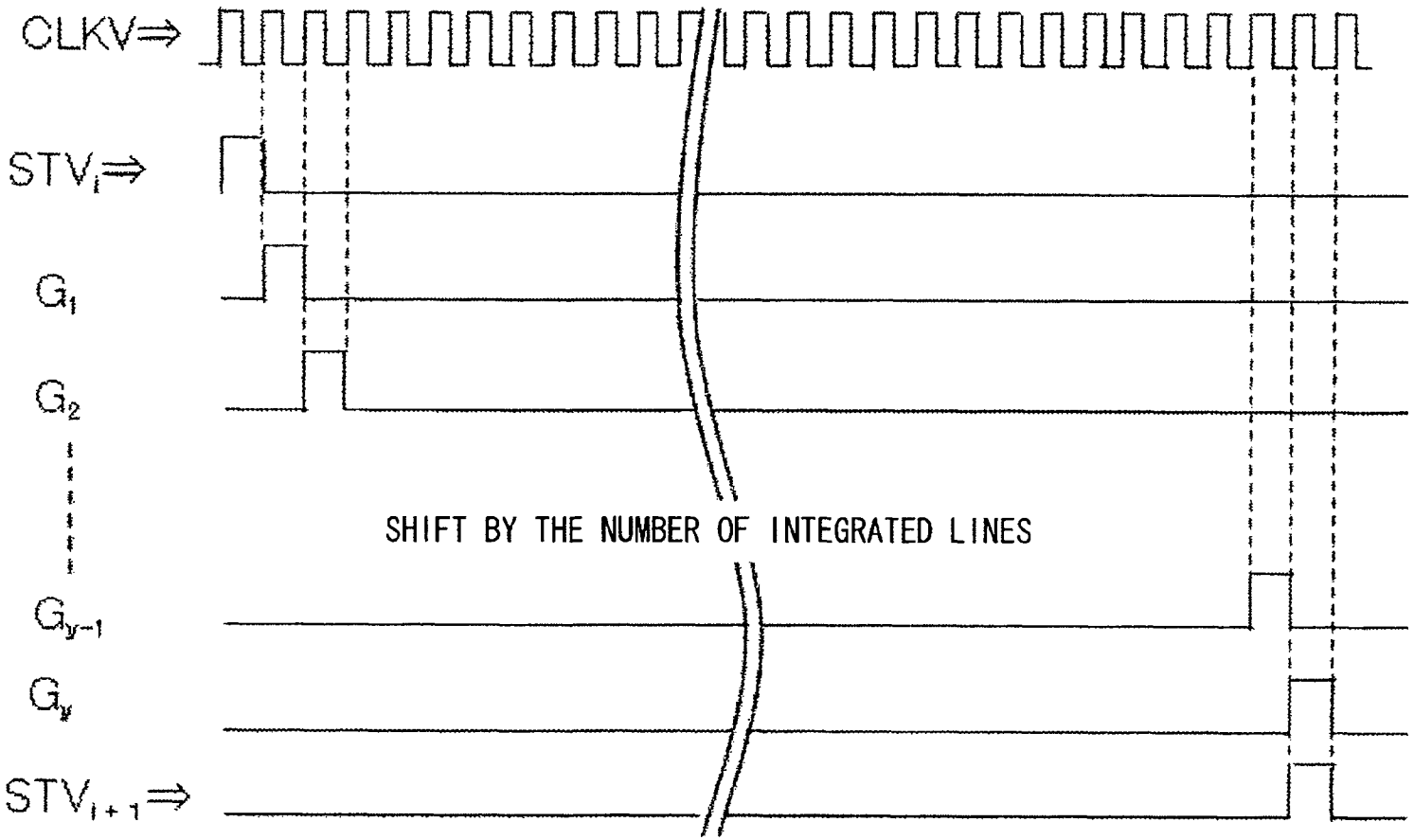
FIG. 5 is a waveform chart showing input/output timings of the scanning line drive circuit of FIG. 4.

FIG. 5 shows a general timing chart of this flow.

In more detail, since the gate drivers 3 to 5 in FIG. 1 each drives y scanning lines 31, y unit gate drivers connected to these scanning lines 31 are integrated inside each thereof. Therefore, by connecting the $STV_{i+1}$ outputted at the same time when driving of all the output lines (y lines) connected to the ante-stage gate driver is completed to the $STV_i$ of the post-stage gate driver in cascade from the gate driver in which the y unit gate drivers are integrated to the post-stage gate drivers, m scanning lines 31 in the liquid crystal panel 2 can be driven with the gate drivers 3 to 5 as a whole. Herein, the cascade connection from the $STV_i$ to the $STV_{i+1}$ is indicated by using the reference signs $STV_1$ and $STV_2$ in FIG. 1.

The control signals of the gate drivers 3 to 5 include the CLKV which determines an operation timing of the gate drivers 3 to 5, the STV which determines a start timing of the vertical scan, an /OE for switching ON and OFF of the output from the gate drivers 3 to 5, and the like.

The STV is a pulse signal which is activated correspondingly to the beginning of each frame period of the RGB-data outputted by the T-CON 14. The STV outputted by the T-CON 14 is inputted to the first-stage, i.e., the forefront-stage gate driver 3 in the cascade connection as the vertical shift start pulse $STV_0$. The shift start pulse $STV_0$ is sequentially transmitted to the gate drivers 4 and 5 in a round, and finally outputted from the last-stage gate driver 5 as a vertical shift complete pulse $STV_3$. At that time, inside each of the gate drivers 3 to 5, each of the cascaded unit gate drivers, in synchronization with the $STV_i$ transmitted from the ante-stage gate driver, drives the corresponding scanning line 31 while sending the $STV_{i+1}$ to the post-stage one.

The activation of a driving signal (gate signal) for the scanning line 31 is made in synchronization with the CLKV. As a result, the plurality of scanning lines 31 become activated (become High) in sequence (in other words, the liquid crystal panel 2 is scanned) in synchronization with the CLKV, and accordingly the TFTs 34 connected to the scanning lines 31, respectively, become ON in sequence in accordance with the corresponding scanning lines 31.

The /OE is a signal used for controlling a period while the RGB-data can be written into a liquid crystal element 33 in the control circuit unit 211, which serves to switch between ON and OFF of the output from the gate drivers 3 to 5. The /OE is a negative logic signal. When the /OE is Low, the gate drivers 3 to 5 perform the above-discussed normal operation (scan of the scanning lines 31), and when the /OE is High, the gate drivers 3 to 5 bring all the scanning lines 31 into Low (in other words, turn all the TFTs 34 off to inhibit the writing of the RGB-data into the liquid crystal elements 33).

Figure 6:
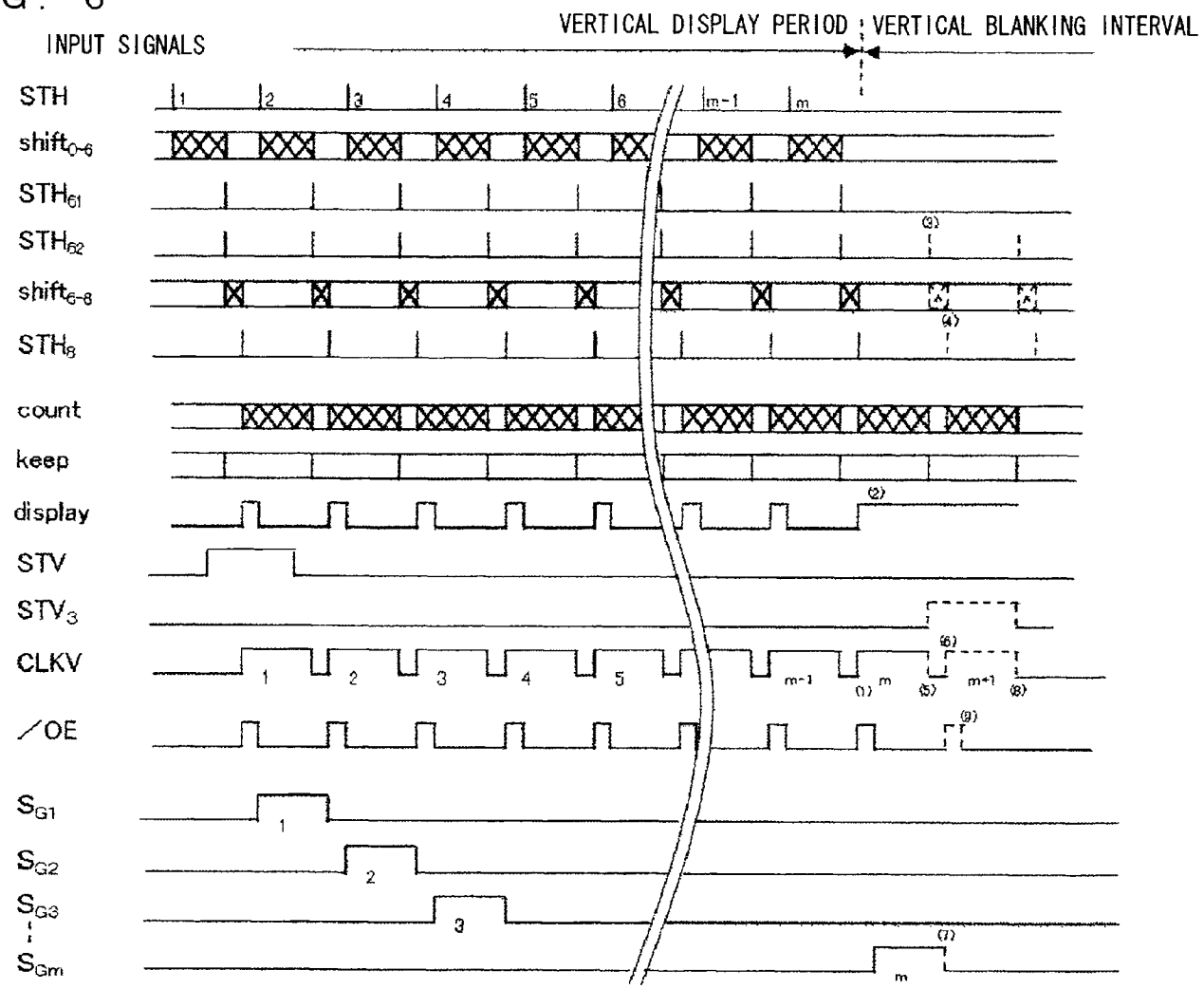
FIG. 6 is a timing chart of main signals inside the liquid crystal display shown in FIG. 1.

FIG. 6 shows a timing chart at the time when the above-discussed source drivers 6 to 13 and gate drivers 3 to 5 are driven in accordance with the first preferred embodiment. The timing control unit 30 in the T-CON 14 includes an STH compensation circuit 40 thereinside, and an exemplary circuit configuration of the STH compensation circuit 40 is shown in FIG. 7.

Figure 7:
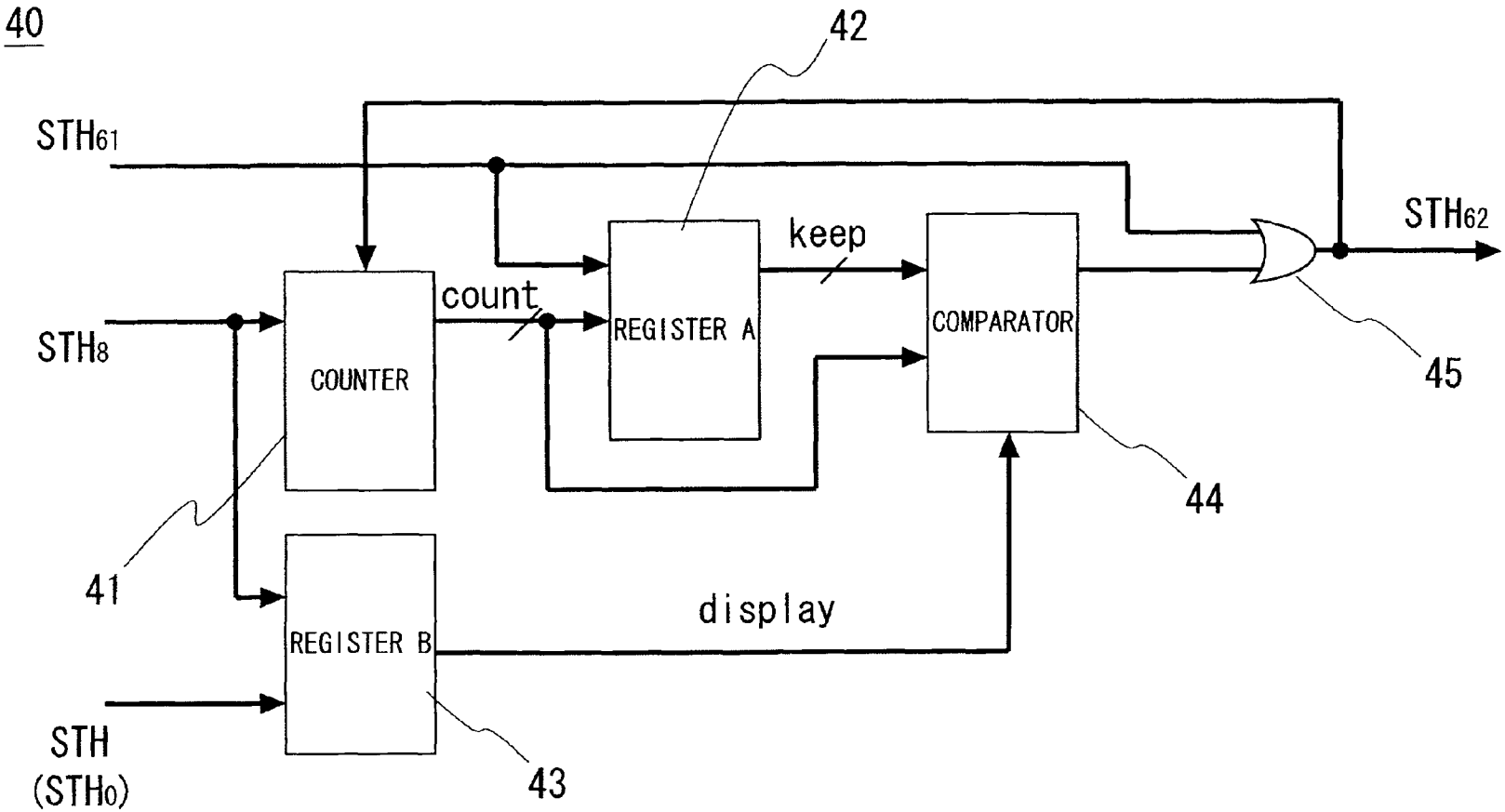
FIG. 7 is an exemplary constitution of an STH compensation circuit in accordance with the first or second preferred embodiment of the present invention.

In FIG. 7, a counter with the reference sign "41" (for counting the DCLK or the CLKH) is so configured as to start counting in response to the input of the shift complete pulse $STH_8$ and stop counting in response to the input of the unit start pulse $STH_{62}$ and outputs a count value "count" thereof to a register A 42 and a comparator 44. The reference sign "42" represents a register A, which stores therein the count value "count" at the time when the unit start pulse $STH_{61}$" is inputted. The reference sign "43" represents a register B which is a flip-flop circuit having an output which becomes High when the unit start pulse $STH_8$ is inputted and becomes Low when the STH (shift start pulse $STH_0$) is inputted, and an output value thereof is represented as "display". The reference sign "44" represents a comparator for comparing an output value "keep" of the register A 42 with the output value "count" of the counter 41, which performs the comparison during the period while the output value "display" of the register B 43 is High and outputs a compensation pulse of one pulse (a coincident pulse of High during one CLKH period) to an OR circuit 45 during the period while the output value "keep" is coincident with the output value "count". The OR circuit 45 takes a logical sum of the unit start pulse $STH_{61}$ and the compensation pulse form the comparator 44 and outputs the logical sum as the unit start pulse $STH_{62}$.

Next, with reference to FIG. 6, discussion will be made on a control flow and an operation of the STH compensation circuit 40. The reference signs STH, $STH_{61}$, $STH_{62}$, $STH_8$, STV, $STV_3$, CLKV, and /OE shown in FIG. 6 are identical to those shown in FIG. 1.

The reference sign "$shift_{0-6}$" in FIG. 6 indicates the state inside the source driver and generally describes the state in which a shift operation is performed among the shift registers inside the source drivers 6 to 11 from the time when the STH is inputted to the source driver 6 to the time when the unit start pulse $STH_{61}$ is outputted from the source driver 11 (It schematically shows the operation of each of the source drivers at the timings $hshift_1$ to $hshift_x$. The shift operation is performed during the periods indicated by the crosshatched parts and no shift operation is performed during the other periods of blank). Similarly, the reference sign "$shift_{6-8}$" in FIG. 6 also indicates the state inside the source driver and generally describes the state in which a shift operation is performed among the shift registers inside the source drivers 12 and 13 from the time when the $STH_{62}$ is inputted to the source driver 12 to the time when the shift complete pulse $STH_8$ is outputted from the source driver 13 (The shift operation is performed during the periods indicated by the crosshatched parts and no shift control is performed during the other periods of blank).

The signal "count" indicates a count value of the counter 41 in the STH compensation circuit 40, and the counter 41 counts up (the DCLK or the CLKH) during a period from the time when the shift complete pulse $STH_8$ is inputted to the STH compensation circuit 40 to the time when the unit start pulse $STH_{62}$ is inputted (The count-up operation is performed during the periods indicated by the crosshatched parts and no count-up operation is performed during the other periods of blank). Further, when the unit start pulse $STH_{61}$ is inputted, the value of the signal "count" is inputted to the register A 42 and the value held therein becomes the signal "keep". At the same time, the count value "count" of the counter 41 is reset. The output value "display" of the register B 43 is an internal signal inside the STH compensation circuit 40, which becomes High in synchronization with the unit start pulse $STH_8$ and becomes Low in synchronization with the STH (shift start pulse $STH_0$).

The reference signs "$S_{G1}$", "$S_{G2}$", "$S_{G3}$", . . . , and "$S_{Gm}$" represent output signals (gate signals) from the gate drivers 3 to 5. When each of these signals is High, the gate signal in the liquid crystal panel 2 is activated, and when Low, the gate signal in the liquid crystal panel 2 is inactivated. Herein, discussion will be made, assuming that there are m scanning lines 31 in the vertical direction.

Respective motions of these signals shown in FIGS. 6 and 7 will be discussed along the control flow. Redundant description in detail on the operations of the above-discussed gate drivers and source drivers, and the like, which have been already discussed will be omitted to avoid complexity.

First, during a normal display period, the STH is outputted from the timing control unit 30 to each line in accordance with the image display data signal RGB-data. This signal STH is shifted in the source drivers 6 to 11 ($shift_{0-6}$), outputted from the source driver 11 as the unit start pulse $STH_{61}$, and inputted once to the timing control unit 30. In more detail, the unit start pulse $STH_{61}$ is inputted to the STH compensation circuit 40. Herein, the first to m-th unit start pulses $STH_{61}$ from the start of display (the first line) are outputted again from the timing control unit 30 to the source driver 12 through the OR circuit 45 of the STH compensation circuit 40 as the unit start pulse $STH_{62}$. The unit start pulse $STH_{62}$ is shifted in sequence in the source drivers 12 and 13 ($shift_{6-8}$), outputted as the shift complete pulse $STH_8$, and inputted to the timing control unit 30.

In this case, the CLKV rises in synchronization with the shift complete pulse $STH_8$ and falls in synchronization with the unit start pulse $STH_{62}$ (the CLKV, however, may be delayed by several clocks, counting the CLKH (or DCLK) for controlling the timing with the latch pulse LP as the control signal in the horizontal direction).

The gate drivers 3 to 5 of the first preferred embodiment are so configured as to shift the STV inputted from the T-CON 14 in synchronization with the rise of the CLKV at the start of scanning of the first line and activate the gate signal in sequence by one line (during a period while the /OE is High, however, the output thereof is inactivated). Therefore, during the normal display period (from the first line to the (m−1)-th line), by causing the CLKV to rise in synchronization with the shift complete pulse $STH_8$ and fall in synchronization with the unit start pulse $STH_{62}$, it is possible to generate the CLKV at a fixed interval and at a fixed duty ratio and consequently possible to activate the gate signal ($S_{G1}$, $S_{G2}$, $S_{G3}$, . . . , and $S_{Gm-1}$) by one line.

Thus, the cycle of the CLKV is determined by using the shift registers in the cascaded source drivers 6 to 13 and the duty ratio of the CLKV is determined depending on which one of the source drivers 6 to 13 from which the unit start pulse (e.g., $STH_{61}$) is once drawn. Therefore, no dedicated counter circuit used for generating the CLKV is needed in the T-CON 14 (no dedicated counter is needed for this operation since the shift registers inside the source drivers 6 to 11 can be used in place of the counter circuit).

This operation, however, can be performed until the rise of the m-th CLKV (the timing (1) in FIG. 6), and since only m STHs (the shift start pulses STH)) can be outputted, normally, the (m+1)-th unit start pulse $STH_{62}$ which is needed to cause the m-th CLKV to fall (to stop the vertical scan) cannot be generated and therefore the shift complete pulse $STH_8$ cannot be also generated.

Then, an internal signal of the timing control unit 30 is used. The above-discussed signal "display" in the STH compensation circuit 40 becomes High in synchronization with the unit start pulse $STH_8$ and becomes Low in synchronization with the STH. The signal "display" repeats the rise and fall (m−1) times from the first line, but since the DENA is not inputted to the T-CON 14 nor the STH cannot be generated during the period from the m-th time and later which is the vertical blanking interval, the signal "display" keeps rising (at the timing (2) in FIG. 6). Then, when the count value "count" of the counter 41 is equal to the output value "keep" of the register A 42 and the signal "display" is High, a pseudo unit start pulse $STH_{62}$ is generated in the STH compensation circuit 40. Specifically, when the signal "display" is High and the output value "keep" of the register A 42 is equal to the count value "count", the comparator 44 outputs a compensation pulse of one clock and this compensation pulse goes through the OR circuit 45 to become the pseudo unit start pulse $STH_{62}$, and it is therefore possible to output the unit start pulse $STH_{62}$ to the next-stage (post-stage) source driver 12 (at the timing (3) in FIG. 6) even during the vertical blanking interval. The unit start pulse $STH_{62}$ is inputted to the source driver 12 and can compensate the (m+1)-th shift complete pulse $STH_8$ (at the timing (4) in FIG. 6). It is thereby possible to raise the m-th CLKV at the same timing as that during the display period (at the timing (5) in FIG. 6).

Further, since the (m+1)-th shift complete pulse $STH_8$ is compensated as discussed above, the (m+1)-th CLKV rises in synchronization with the shift complete pulse $STH_8$ (at the timing (6) in FIG. 6) and falls in synchronization with the unit start pulse $STH_{62}$ (at the timing (8) in FIG. 6), to thereby activate the gate signal by one line at a fixed interval (at the timing (7) of the waveform $S_{Gm}$ in FIG. 6).

Therefore, the (m+1)-th CLKV can be also generated at the same timing as that of the m-th CLKV (at the timings (5), (6), and (8) in FIG. 6)

Thus, since the gate signal $S_{Gm}$ can be made High (can be activated) during the same period as that of the $S_{G1}$, $S_{G2}$, $S_{G3}$, . . . , and $S_{Gm-1}$ in the display period, the display of the last line can also have the same quality as that of the other lines.

Therefore, even without holding the resolution in the vertical direction, it is possible to perform a uniform driving of the scanning lines until the last line in accordance with the period length of the externally-inputted HD, VD, and DENA. Thus, in the first preferred embodiment, it is not necessary to hold the respective resolutions in the vertical direction and horizontal direction as parameters in the timing controller and accordingly, no register or memory for holding the display resolution is needed in the timing controller. Therefore, no memory for holding the resolution needs to be provided outside the timing controller.

Though not shown, it is easy to recognize the start of the vertical blanking interval in the timing control unit 30, and it is therefore possible to stop the CLKV at a desired times in the vertical blanking interval.

Further, by causing the rise timing of the /OE to be in synchronization with the rise of the CLKV, the fall timing can be generated by using the count value "count" in the timing control unit 30 (at the timing (9) in FIG. 6).

The Second Preferred Embodiment

The circuit configuration of a liquid crystal display 1 in accordance with the second preferred embodiment is the same as that of the first preferred embodiment shown in FIG. 1 and detailed description thereof will be omitted.

Figure 8:
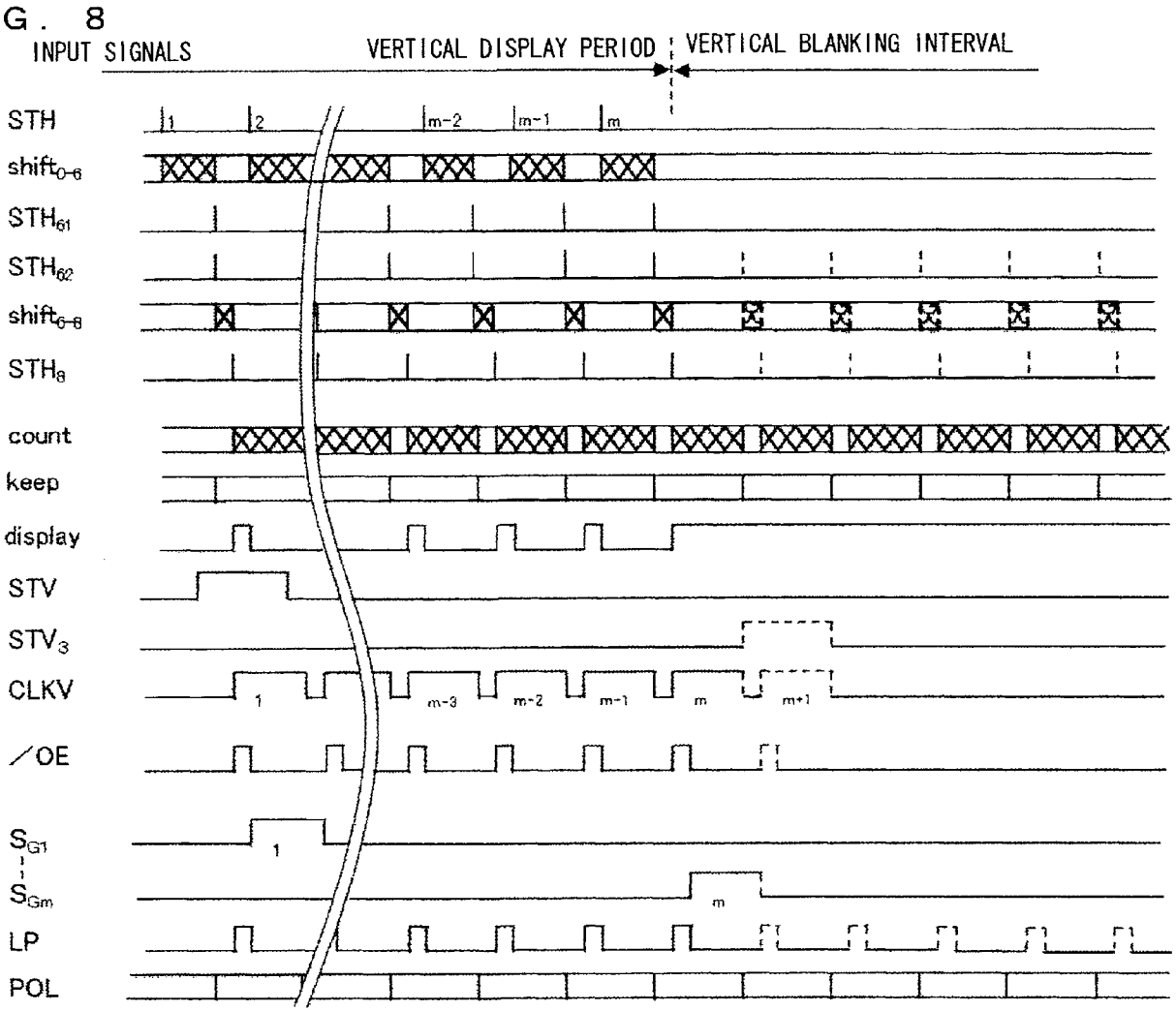
FIG. 8 is a timing chart of main signals inside a liquid crystal display in accordance with the second preferred embodiment of the present invention.

FIG. 8 is a timing chart of a case where the source drivers 6 to 13 and the gate drivers 3 to 5 shown in FIG. 1 are driven in accordance with the second preferred embodiment. In the second preferred embodiment, by using the shift registers in the source drivers shown in FIG. 8, the latch pulse LP and the POL are driven even in the vertical blanking interval and writing is performed into the pixels for each horizontal period and the same driving as that in the display period is performed even in the vertical blanking interval.

The latch pulse LP is used for transmitting image data to the output side of the video signal line drive circuit and the POL signal which is schematically shown in FIG. 8 is a polarity switching signal for indicating a polarity in driving the liquid crystal, which is a well-known signal of which the polarity is inverted between a horizontal period and a vertical period. The timing chart of FIG. 8 is a waveform chart showing flows of signals in accordance with the second preferred embodiment in the circuit shown in FIG. 1. The respective signals represented by the reference signs "STH", "$shift_{0-6}$", "$STH_{61}$", "$STH_{62}$", "$shift_{6-8}$", "$STH_8$", "count", "keep", and "display" have the same timings as those in the above-discussed first preferred embodiment, and the description thereof will be omitted.

The latch pulse LP is generated with the shift complete pulse $STH_8$ as a trigger and the POL signal is inverted in polarity of High/Low with the shift start pulse $STH_{62}$ as a trigger.

In this case, the STH, the $shift_{0-6}$, the unit start pulse $STH_{61}$, the unit start pulse $STH_{62}$, the $shift_{6-8}$, the shift complete pulse $STH_8$, the count value "count", the output value "keep", and the output value "display" are controlled as follows. A compensation number counter (not shown) or the like for counting the number of compensation pulses outputted from the comparator 44 is additionally provided and so configured as to count the unit start pulses $STH_{62}$ which are generated and compensated in the STH compensation circuit 40 and generate a predetermined number of unit start pulses $STH_{62}$. This allows the STH compensation circuit 40 to operate for a desired period in the vertical blanking interval, and the above signals can be continuously controlled in accordance with the HD, the VD, the DENA, and the DCLK inputted to the liquid crystal display during the period while the unit start pulse $STH_{62}$ is generated by the compensation pulse of the STH compensation circuit 40.

Therefore, during the above-discussed compensation period, the shift complete pulse $STH_8$ and the unit start pulse $STH_{62}$ are used as triggers. The latch pulse LP and the POL can be continuously outputted for a desired period like the above, to thereby continuously control the video signal line drive circuits. By configuring the compensation number counter to be reset by the input of the STH (shift start pulse STH)) which is generated in accordance with the start of the vertical scan, it is possible to initialize the compensation number counter at the start of the vertical scan.

Thus, by using the shift registers in the video signal line drive circuits, it is possible to easily perform alternating control during the vertical blanking interval.

Though the interconnection in the conventional liquid crystal display, which corresponds to the unit start pulse $STH_6$, is taken at some midpoint and divided into the unit start pulses $STH_{61}$ and $STH_{62}$ in the circuit configuration of the liquid crystal display (FIG. 1) of the first and second preferred embodiments, the control may be performed by giving an interrupt between the other cascaded source drivers, such as the unit start pulse $STH_5$, without departing from the product specification of the liquid crystal display or the specification of the gate driver.

Further, though the T-CON and the source drivers are integrated separately in the first and second preferred embodiments, the first or/and second preferred embodiment(s) may be applied to the source drivers incorporating the T-CON. The gate drivers may be also integrated in the same semiconductor.

Then, when the T-CON is incorporated in the gate drivers, the same effect can be produced.

Furthermore, the first or/and second preferred embodiment(s) may be applied to the source drivers incorporating the T-CON and the gate drivers may be integrated in the same semiconductor.

By integrating the T-CON and the source drivers, it becomes easier to use the state in the shift operation of the shift registers directly for the interrupt control instead of the interrupt using the unit start pulse $STH_{61}$ and the unit start pulse $STH_{62}$.

As discussed above, since no memory needs to be provided outside the timing controller to hold the respective resolutions in the vertical direction and horizontal direction and the number of counters can be reduced as compared with the conventional case in the first and second preferred embodiments, it is possible to reduce the circuit scale of the timing controller and it consequently becomes easier to incorporate the timing controller in the source drivers and/or the gate drivers.

The signals described in the first and second preferred embodiments are only main signals needed for discussion on the control, and actually several kinds of other signals are needed to control the source drivers and the gate drivers for driving the liquid crystal panel.

Finally, though the exemplary case using the liquid crystal panel has been discussed as an example of the matrix display panel in the first and second preferred embodiments, the present invention may be applied to a display device with a plurality of resolutions, which has a display area in matrix such as an organic EL display, a plasma display panel, or the like.

While the invention has been shown and described in detail, the foregoing description is in all aspects illustrative and not restrictive. It is therefore understood that numerous modifications and variations can be devised without departing from the scope of the invention.

What is claimed is:

1. A matrix display device, comprising:

a matrix board in which a plurality of pixels surrounded by m scanning lines and n video signal lines are arranged in matrix, for controlling a plurality of pixel transistors connected to said pixels on conduction by a gate signal supplied through said scanning lines and supplying a pixel writing voltage supplied through said video signal lines to said pixels through said pixel transistors;

a scanning line drive circuit for supplying said gate signal to said scanning lines;

a plurality of video signal line drive circuits for supplying said pixel writing voltage to said video signal lines; and a timing controller for outputting a display control data signal including a shift start pulse to said video signal line drive circuits and outputting a horizontal scan control signal including a vertical clock to said scanning line drive circuit, wherein each of unit start pulses inputted/outputted to/from said plurality of video signal line drive circuits is cascaded between an ante-stage video signal line drive circuit and a post-stage video signal line drive circuit in said plurality of video signal line drive circuits, said shift start pulse outputted from said timing controller is inputted to a first-stage video signal line drive circuit, the duty ratio of said vertical clock is controlled by one of said plurality of cascaded unit start pulses, and the duty ratio of said vertical clock that is controlled by said one of said plurality of cascaded unit start pulses is fixed during a vertical display period.

2. The matrix display device according to claim 1, further comprising:

a start pulse compensation circuit to which said shift start pulse, a unit start pulse from said ante-stage video signal line drive circuit, and a shift complete pulse from a last-stage video signal line drive circuit are inputted and which outputs a unit start pulse to said post-stage video signal line drive circuit, wherein said vertical clock is so driven as to rise in synchronization with said shift complete pulse and fall in synchronization with said unit start pulse to be outputted to said post-stage video signal line drive circuit, and said start pulse compensation circuit generates said unit start pulse to be outputted to said post-stage video signal line drive circuit, to thereby compensate said vertical clock, in a vertical blanking interval.

3. The matrix display device according to claim 2, wherein a polarity switching signal is generated in synchronization with said compensated vertical clock in said vertical blanking interval.

4. The matrix display device according to claim 3, wherein the polarity of said polarity switching signal is inverted with said unit start pulse as a trigger.

5. The matrix display device according to claim 1, wherein a cascaded unit start pulse inputted/outputted to/from said plurality of video signal line drive circuits is input into the timing controller.

6. A method of driving a matrix display device, wherein a unit start pulse is cascaded among a plurality of video signal line drive circuits in a matrix display device, and the duty ratio of a vertical clock to be inputted to a scanning line drive circuit is controlled by using a unit start pulse to be outputted from one of said plurality of video signal line drive circuits to the post-stage video signal line drive circuit, and the duty ratio of said vertical clock that is controlled by said unit start pulse outputted from said one of said plurality of video signal line drive circuits is fixed during a vertical display period.

7. The method of driving a matrix display device according to claim 6, wherein said vertical clock is so driven as to rise in synchronization with a shift complete pulse and fall in synchronization with said unit start pulse to be outputted to said post-stage video signal line drive circuit, and said unit start pulse to be outputted to said post-stage video signal line drive circuit is generated by using said shift complete pulse and a counter, to thereby compensate said vertical clock, in a vertical blanking interval.

8. The method of driving a matrix display device according to claim 6, wherein said unit start pulse to be outputted from one of said plurality of video signal line drive circuits to the post-stage video signal line drive circuit is input into the timing controller.

* * * * *